United States Patent [19]

Mansfield

[11] 4,124,007

[45] Nov. 7, 1978

[54] FIXED METERED ORIFICE DEVICE FOR PCV SYSTEMS OF INTERNAL COMBUSTION ENGINES

[76] Inventor: William R. Mansfield, 5 Metro Ave., Moonachie, N.J. 07074

[21] Appl. No.: 760,969

[22] Filed: Jan. 21, 1977

Related U.S. Application Data

[63] Continuation of Ser. No. 620,174, Oct. 6, 1975, abandoned.

[51] Int. Cl.[2] ..... F02M 25/06

[52] U.S. Cl. ..... 123/119 B

[58] Field of Search ..... 123/119 B, 141; 48/180 R

[56] References Cited

U.S. PATENT DOCUMENTS

| | | | |
|---|---|---|---|
| 2,291,879 | 8/1942 | Chandler | 123/119 B |
| 2,720,196 | 10/1955 | Wolf | 123/141 |
| 2,818,052 | 12/1957 | Trainer | 123/119 B |
| 3,059,628 | 10/1962 | Linn | 123/119 B |
| 3,172,348 | 3/1965 | Berg | 123/119 B |
| 3,176,670 | 4/1965 | Sinibaldi | 123/119 B |
| 3,177,858 | 4/1965 | Vanderpoel | 123/119 B |
| 3,564,580 | 2/1971 | Cinque | 123/141 |
| 3,712,281 | 1/1973 | Ruth | 123/119 B |
| 3,820,518 | 6/1974 | Dolfi | 123/119 B |
| 3,990,420 | 11/1976 | Bitterman | 123/119 B |

FOREIGN PATENT DOCUMENTS

| | | | |
|---|---|---|---|
| 1,309,312 | 10/1962 | France | 123/119 B |

*Primary Examiner*—Charles J. Myhre
*Assistant Examiner*—Jeffrey L. Yates
*Attorney, Agent, or Firm*—Oblon, Fisher, Spivak, McClelland & Maier

[57] ABSTRACT

A positive crankcase ventilation (PCV) metering device is adapted to be interposed between and fluidically connected to a conventional PCV valve at one end thereof and to the engine intake manifold at the other end thereof. The device has an axial passageway extending therethrough for conducting the vapors from the crankcase to the intake manifold, and a plurality of orifices, defined within and about the periphery of the device, are fluidically connected to the axial passageway and to atmosphere so as to always supply a metered amount of atmospheric air to the passageway under all engine conditions, whereby the high differential pressure across the PCV valve will be substantially reduced so as not to draw an excessive amount of oil droplets or vapor from the crankcase.

10 Claims, 1 Drawing Figure

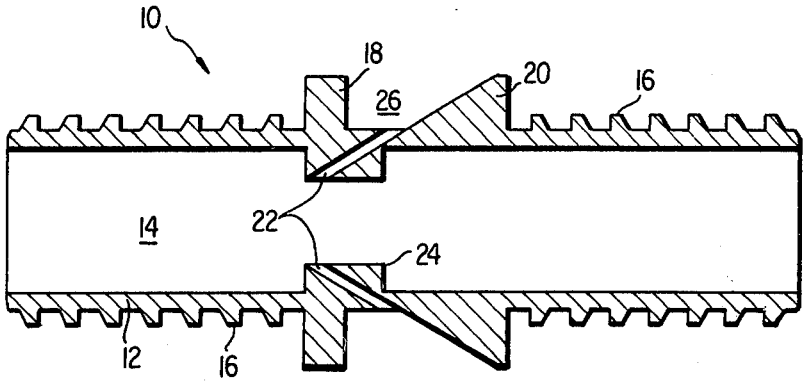
10
18
20
16
26
14
22
24
12
16

FIXED METERED ORIFICE DEVICE FOR PCV SYSTEMS OF INTERNAL COMBUSTION ENGINES

This is a continuation, of application Ser. No. 620,174, filed Oct. 6, 1975.

BACKGROUND OF THE INVENTION

1. Field of the Invention

The present invention relates generally to metered orifice devices, and more particularly to a fixed metered orifice device for use within PCV systems of internal combustion engines whereby air is introduced into the PCV system in order to control the vapor content within the gaseous stream normally conducted from the engine crankcase to the intake manifold of the engine.

2. Description of the Prior Art

Various products of combustion are produced within internal combustion engines and may include carbon dioxide, carbon monoxide, non-combusted and partially combusted hydrocarbons, oxides of nitrogen and sulphur, and water. The emission of these constituents into the atmosphere by automobiles has contributed greatly to the high levels of air pollution currently being experienced, especially within metropolitan areas. One major source of this emission has been caused by the so-called "blowby" gases which comprise some of the above-mentioned constituents and which are normally forced past the engine pistons and rings and into the engine crankcase. These "blowby" gases are, in turn, mixed with oil vapors containing tars, varnishes, gums, and sludge, which are produced within the crankcase, along with fine oil particles, and the resulting mixture has traditionally been vented from the crankcase into the atmosphere.

In an attempt to reduce such air pollution caused by the emission of these harmful constituents from the engine crankcases, recent legislation has been enacted requiring the passage of such vapors from the crankcase into the engine's fuel-intake system, and this is generally provided for by means of a conduit having a positive crankcase ventilation (PCV) valve disposed therewithin and communicating between the upper region of the engine crankcase, that is, above the oil level, and the engine fuel-intake system. The PCV valve is merely a one-way check valve which allows the crankcase vapors to flow only in one direction, that is, from the crankcase to the fuel-intake system, and this allows for any non-combusted constituents disposed within such crankcase vapors to be recharged into the engines and completely combusted.

Various problems have resulted, however, when utilizing such PCV systems, such as for example, the deposition of tars and sludge within the engine carburetor and/or intake manifold, as well as the upper valve systems, and this particular problem has been only partially remedied by placing a filtering device within the PCV line so as to remove the heavier tars, varnishes, and sludges from the vapor stream. In addition, it is also noted that conventional carburetion equipment is not particularly adapted to effectively mix the additional vaporous combustible products with air so as to provide a highly efficient combustible mixture, and consequently, much of the recirculated mixture is removed from the engine exhaust system in a non-combusted or only partially combusted state.

Still further, it has also heretofore been proposed to incorporate spring-loaded valves within the PCV system which partially restrict the flow of air and vapors through the PCV system when the pressure within the intake manifold drops below a predetermined level. Such devices, have been found to create an excessive amount of suction within the PCV system so as to, in fact, draw oil out of the crankcase, and it is not unusual to find the spark plugs fouled with oil and vapors after the engine has been running at high speeds and then throttled down, due to liquids and vapors being pulled through the system into the cylinders. In addition, the spring-loaded valves themselves become fouled and fail to function properly.

In order to rectify the aforenoted problems, additional atmospherically-vented spring-loaded valves have also been incorporated within the PVC system so as to bleed thereinto a metered or controlled amount of atmospheric air whereby, even when high vacuum conditions exist within the engine intake manifold, the vacuum within the PCV lines leading from the crankcase does not in fact exceed a predetermined maximum. Consequently, such vacuum is insufficient to cause oil or vapors to be sucked out of the crankcase and into the intake manifold. Nevertheless, such additional valves have also become fouled within a relatively short period of time and consequently fail to perform properly.

SUMMARY OF THE INVENTION

Accordingly, it is an object of the present invention to provide an improved positive crankcase ventilation metering device.

Another object of the present invention is to provide an improved PCV metering device which overcomes the aforementioned drawbacks of conventional devices.

Still another object of the present invention is to provide an improved PCV metering device which will not become fouled during operation of the internal combustion engine.

Yet another object of the present invention is to provide an improved PCV metering device which always bleeds a metered or controlled amount of atmospheric air into the PCV system whereby the vacuum within the PCV system will be insufficient to cause an excessive amount of oil or vapor to be sucked from the crankcase into the engine intake manifold.

Still yet another object of the present invention is to provide an improved PCV metering device which reduces engine oil comsumption.

A further object of the present invention is to provide an improved PCV metering device which always bleeds a metered or controlled amount of atmospheric air into the PCV system whereby the additional bled air breaks up and carburets the hydrocarbons within the PCV system so as to facilitate their introduction into the engine intake manifold and mingling of the same with the air-fuel mixture from the carburetor so as to attain complete combustion thereof.

A still further object of the present invention is to provide an improved PCV metering device which facilitates the efficient combustion of engine vaporous constituents and substantially decreases the quantity of harmful exhaust emissions discharged from internal combustion engines.

A yet further object of the present invention is to provide an improved PCV metering device which increases vehicle mileage per unit of fuel.

A still yet further object of the present invention is to provide an improved PCV metering device which is quite simple and inexpensive to manufacture.

The foregoing and other objectives are achieved according to the present invention through the provisions of a PCV metering device which includes an elongated cylindrical member having an axial passageway therethrough. One end of the device is adapted to be fluidically connected to a fluid conduit or hose leading to a conventional PCV valve of a positive crankcase ventilation system, while the other end of the device is adapted to be fluidically connected to another fluid conduit or hose leading to the engine intake manifold. The external peripheral surface of the device is ribbed so as to facilitate retention of the hoses thereon, and a pair of annular, axially spaced shoulders are provided externally of the device and at the central portion thereof for limiting or defining the longitudinal disposition of the hose sections upon the device. The configuration of one of the shoulders is that of a flat disc, while the configuration of the other one of the shoulders is that of a truncated cone, and a plurality of atmospheric air metering orifices, defined between the shoulders and peripherally disposed about the device in an equiangular arrangement, are fluidically connected to the axial passageway. The orifices are inclined with respect to the axis of the device and in the direction leading toward the intake manifold end thereof, and the angle of inclination coincides with the angle defined between the frusto-conical surface of the conical shoulder and the longitudinal axis of the device whereby the frusto-conical surface serves as a guide means facilitating the introduction of the atmospheric air through the orifices and into the axial passageway of the device so as to mingle with the crankcase vapors passing therethrough to the engine intake manifold.

BRIEF DESCRIPTION OF THE DRAWING

Various other objects, features, and attendant advantages of the present invention will be more fully appreciated as the same becomes better understood from the following detailed description when considered in connection with the accompanying drawing, wherein:

The sole FIGURE is a longitudinal cross-sectional view of a PCV metering device constructed in accordance with the present invention and showing its cooperative parts.

DETAILED DESCRIPTION OF THE ILLUSTRATED EMBODIMENT

Referring now to the drawing, there is shown a positive crankcase ventilation metering device, generally indicated by the reference character 10 and comprising an elongated cylindrical member 12 having an axial passageway 14 defined therethrough, member 12 being fabricated, for example, from a suitable non-ferrous metal or plastic. As viewed in the drawing, the right end portion of the device is adapted to be fluidically connected to a conventional PCV valve, not shown, by means of, for example, a fluid conduit or hose, also not shown, while the left end portion of the device is similarly adapted to be fluidically connected to the engine intake manifold, not shown, by means of, for example, another fluid conduit or hose, also not shown. A plurality of axially spaced, annular ribs 16 are integrally formed upon the external peripheral surface of member 12 so as to facilitate the retention of the hoses upon the end portions thereof, and it is apparent that suitable fastening members, not shown, such as for example, flexible clamps, bands, or the like, may be disposed about the hoses when the latter have been placed upon the ribbed sections 16 of member 12 in order to fixedly retain the same thereon.

A pair of annular, axially spaced shoulders 18 and 20 are also integrally formed upon the external peripheral surface of member 12 at the central portion thereof so as to limit or define the longitudinal disposition of the hose sections upon the device. A plurality, such as for example, five, of metering orifices 22 are provided within the device such that the radially outer end of each orifice is defined within the outer peripheral surface of member 12 so as to be open to and fluidically connected with the atmosphere, while the radially inner end of each orifice is defined within an annular rib 24 integrally formed upon the inner peripheral surface of member 12 so as to be open to and fluidically connected with the axial passageway 14.

As noted heretofore, five of such orifices 22 may be provided within the device and they may be equiangularly disposed about the periphery thereof, the orifices therefore being separated from one another through an angular displacement of approximately 72°. In addition, it will also be noted from the FIGURE, that the orifices are inclined relative to the longitudinal axis of the member 12, the angle of inclination being, for example, within the range of 15°–30°, and it will be appreciated that the direction of inclination extends from the external periphery of member 12 to the internal periphery of rib 24 and from the right end of member 12, which end is adapted to be connected to the PCV valve, towards the left end of member 12, which end is adapted to be connected to the engine intake manifold, in order to accomplish the purposes of the present invention.

Shoulder 18 has a configuration which resembles a flat, annular disc or ring, while the configuration of shoulder 20 resembles an annular, truncated cone. As the radially outer end portions of the orifices 22 are interposed between shoulders 18 and 20, and the inclination of the conical surface of shoulder 20 coincides with that of the orifices 22, it is seen that the shoulders 18 and 20 cooperate in forming an annular guide channel 26, and more particularly, the conical surface 28 of shoulder 20 forms a guide surface, facilitating the introduction of atmospheric air into orifices 22 and ultimately into passageway 14 for co-mingling with the crankcase vapors being conducted through passageway 14 from the crankcase and the PCV valve to the engine intake manifold.

In operation, atmospheric air will always be drawn through orifices 22 and into the device due to the fact that the orifices 22 always and continuously fluidically connect axial passageway 14 with the atmosphere and in this manner, the creation of an adverse pressure differential across the PCV valve, which tends to draw an excessive quantity of oil, in the form of droplets or vapor out of the crankcase which thereby fouls various components of the engine and PCV system, is effectively prevented. This in turn substantially reduces oil comsumption, and in addition, the device of the present invention permits a metered or controlled amount of atmospheric air to enter the device as a function of the manifold pressure and to intermingle with the vapors drawn from the crankcase so as to atomize and carburet the same throughout the throttle range and thereby facilitate complete combustion of the same within the engine. In this manner, the operation of the engine is noticeably smoother throughout the throttle range and the quantity of pollutants exhausted into the atmosphere is drastically reduced. It may thus be appreciated that as the device of the present invention has orifices which are fixed and always open to the atmosphere, as opposed to conventional devices which include spring-loaded valve structures, which tend to become fouled, the device of the present invention has important advantages over the known prior art.

Obviously, many modifications and variations of the present invention are possible in light of the above teachings. For example, in lieu of the device being interposed between the PCV valve and the engine intake manifold, the device may be directly secured to the engine crankcase. In order to accomplish such, the crankcase end of the device is simply diametrically enlarged so as to accommodate the same within the crankcase. It is to be understood therefore that within the scope of the appended claims, the present invention may be practiced otherwise than as specifically described herein.

What is claimed as new and desired to be secured by letters patent of the United States is:

1. A positive crankcase ventilation metering device for a motor vehicle internal combustion engine having a crankcase and an intake manifold, comprising:

an elongated cylinder member having an axial passageway defined therethrough, one end of said member being adapted to be connected to the crankcase of said motor vehicle internal combustion engine while the other end of said member is adapted to be connected to the intake manifold of said engine, whereby crankcase vapors may be conducted from said crankcase to said intake manifold;

fluid passageway means defined within said member for continuously fluidically communicating said axial passageway with atmosphere so as to continuously introduce air into said axial passageway, said fluid passageway means including a plurality of fluid passages disposed about the periphery of said member, the radially outer portions of said passages being defined within the external peripheral surface of said member and open to atmosphere, the radially inner portions of said passages being defined within the internal peripheral surface of said member and open to said axial passageway, said passages being inclined with respect to the axis of said member and extending radially inwardly from the outer peripheral surface of said member and in the direction extending from said crankcase end of said member to said manifold end of said member, a pair of shoulders integrally formed upon said external peripheral surface of said member for limiting the longitudinal disposition upon said member of fluid hoses fluidically connecting said device to said manifold and said crankcase, said outer portions of said passages being defined between said shoulders, said shoulders thereby defining an air channel for conducting said atmospheric air into said passageways, the configuration of one of said shoulders being that of a truncated cone, the angle of inclination of the conical surface of said one of said shoulders coinciding with the angle of inclination of said passages, whereby said conical surface serves as a guide for conducting said air to said passageways, and said continuous introduction of air into said axial passageway prevents the creation of a pressure differential across said crankcase as normally created by the vacuum within said intake manifold, as well as carburets said crankcase vapors so as to facilitate combustion of the same within said engine, under all engine throttle conditions.

2. A metering device as set forth in claim 1, wherein: said plurality of passages are equiangularly disposed about the periphery of said member.

3. A metering device as set forth in claim 1, wherein: said angle of inclination of said passages is within the range of 15°-20°.

4. A metering device as set forth in claim 1, including: rib means integrally formed upon the external peripheral surface of said member for facilitating retention of fluid hoses fluidically connecting said device to said manifold and said positive crankcase ventilation valve.

5. A metering device as set forth in claim 4, wherein: said rib means are annularly disposed about, and axially spaced along, said member.

6. A positive crankcase ventilation metering device for a motor vehicle internal combustion engine having a positive crankcase ventilation valve and an intake manifold, comprising:

an elongated cylinder member having an axial passageway defined therethrough, one end of said member being adapted to be connected to the positive crankcase ventilation valve of said motor vehicle internal combustion engine while the other end of said member is adapted to be connected to the intake manifold of said engine, whereby crankcase vapors may be conducted from said positive crankcase ventilation valve to said intake manifold;

fluid passageway means defined within said member for continuously fluidically communicating said axial passageway with atmosphere so as to continuously introduce air into said axial passageway, said fluid passageway means including a plurality of fluid passages disposed about the periphery of said member, the radially outer portions of said passages being defined within the external peripheral surface of said member and open to atmosphere, the radially inner portions of said passages being defined within the internal peripheral surface of said member and open to said axial passageway, said passages being inclined with respect to the axis of said member and extending radially inwardly from the outer peripheral surface of said member and in the direction extending from said positive crankcase ventilation valve end of said member to said manifold end of said member, a pair of shoulders integrally formed upon said external peripheral surface of said member for limiting the longitudinal disposition upon said member of fluid hoses fluidically connecting said device to said manifold and said positive crankcase ventilation valve;

said outer portions of said passages being defined between said shoulders, said shoulders thereby defining an air channel for conducting said atmospheric air into said passageways, the configuration of one of said shoulders being that of a truncated cone the angle of inclination of the conical surface of said one of said shoulders coinciding with the angle of inclination of said passages, whereby said conical surface serves as a guide for conducting said air to said passageways, and said continuous introduction of air into said axial passageway prevents the creation of a pressure differential across said positive crankcase ventilation valve as normally created by the vacuum within said intake manifold, as well as carburets said crankcase vapors so as to facilitate combustion of the same within said engine, under all engine throttle conditions.

7. A metering device as set forth in claim 6, wherein: said plurality of passages are equiangularly disposed about the periphery of said member.

8. A metering device as set forth in claim 6, wherein: said angle of inclination of said passages is within the range of 15°–30°.

9. A metering device as set forth in claim 6, including: rib means integrally formed upon the external peripheral surface of said member for facilitating retention of fluid hoses fluidically connecting said device to said manifold and said positive crankcase ventilation valve.

10. A metering device as set forth in claim 9, wherein: said ribs are annularly disposed about, and axially spaced along, said member.

* * * * *